US005088791A

United States Patent [19]

Conley et al.

[11] Patent Number: 5,088,791

[45] Date of Patent: Feb. 18, 1992

[54] SEAT FRAME ARM REST BRACKET

[75] Inventors: John Conley; Alan Neterer, both of Goshen, Ind.

[73] Assignee: Goshen Cushion, Inc., Goshen, Ind.

[21] Appl. No.: 620,660

[22] Filed: Dec. 3, 1990

[51] Int. Cl.[5] ..... A47C 7/54

[52] U.S. Cl. ..... 297/417; 297/416

[58] Field of Search ..... 297/416, 417, 411, 422

[56] References Cited

U.S. PATENT DOCUMENTS 2,661,227 12/1953 Murphy ..... 297/416 X
3,316,018 4/1967 Stith ..... 297/416 X
4,707,032 11/1987 Chang ..... 297/417 X
4,848,840 7/1989 Toya ..... 297/417

*Primary Examiner*—Laurie K. Cranmer
*Attorney, Agent, or Firm*—James D. Hall

[57] ABSTRACT

An arm rest bracket for pivotal connection of an arm rest to a vehicle seat frame. The bracket includes a plastic insert frictionally engaging the arm rest connecting rod and locking pin for reducing vibration noise while the vehicle is moving. The insert includes a camming surface to assist in connecting the arm rest to the bracket. The insert further includes abutments for guiding the stop pin to provide easy removal of the arm rest from the bracket.

2 Claims, 1 Drawing Sheet

SEAT FRAME ARM REST BRACKET

FIELD OF THE INVENTION

This invention relates to a bracket for a seat frame arm rest and has special application to an arm rest bracket having a plastic camming insert.

BACKGROUND OF THE INVENTION

Arm rests for vehicle seats such as commonly used in recreational vehicles are typically pivotally connected to the seat frame and are shiftable between a generally horizontal position and generally vertical position. This pivotal connection of the arm rest to the seat frame permits the arm to be raised for easier passenger entrance or exit. It is further common for the arm rest to be removable.

Heretofore the pivotal connection between the frame and arm rests included a generally U-shaped metal bracket welded to the frame and a metal shaft carried by the arm rest. A stop is carried by the shaft to contact abutments on bracket to define the horizontal and vertical limits of the arm rest. The stop also provides removal of the arm only when positioned at a predetermined keyed location relative to the bracket. Removal of the arm rest requires the user to blindly position the stop pin within keyed opening of the bracket. The metal-on-metal contact of the prior art bracket and arm rest shaft creates a vibration noise when the vehicle is traveling. The generally loose fit of the shaft to the bracket required for proper operation enhanced the vibration noise created.

One apparent attempt to reduce this noise involved the use of a plastic or nylon bushing which is carried by a bracket. However with the prior art bracket, the shaft carried by the arm rest requires additional machining as compared to the more common shaft and stop pin previously described.

SUMMARY OF THE INVENTION

The seat frame arm rest bracket of this invention eliminates the problems discussed above by providing a U-shaped metal bracket having a plastic or nylon insert for use with the more common arm rest connection shaft and pin. The insert contacts the stop pin and acts as a camming surface to properly position the stop pin during use and reduces vibration noise of the bracket and pin. The insert also provides alignment of the stop pin with a keyed bracket opening for easy removal of the arm rest. The bracket and insert accommodate the prior art arm rest connection shaft and stop pin without requiring additional machining of the shaft.

Accordingly, it is an object of the invention to provide for a novel seat frame arm rest bracket having a novel insert.

Another object of the invention is to provide for a novel seat frame arm rest bracket having a nylon insert forming a camming surface.

Another object of this invention is to provide a novel insert for a seat frame bracket which aligns the stop pin of an arm rest shaft for removal.

Other objects of the invention will become apparent upon a reading of the following description taken with the accompanying drawings.

DESCRIPTION OF THE PREFERRED EMBODIMENT

Figure 1:
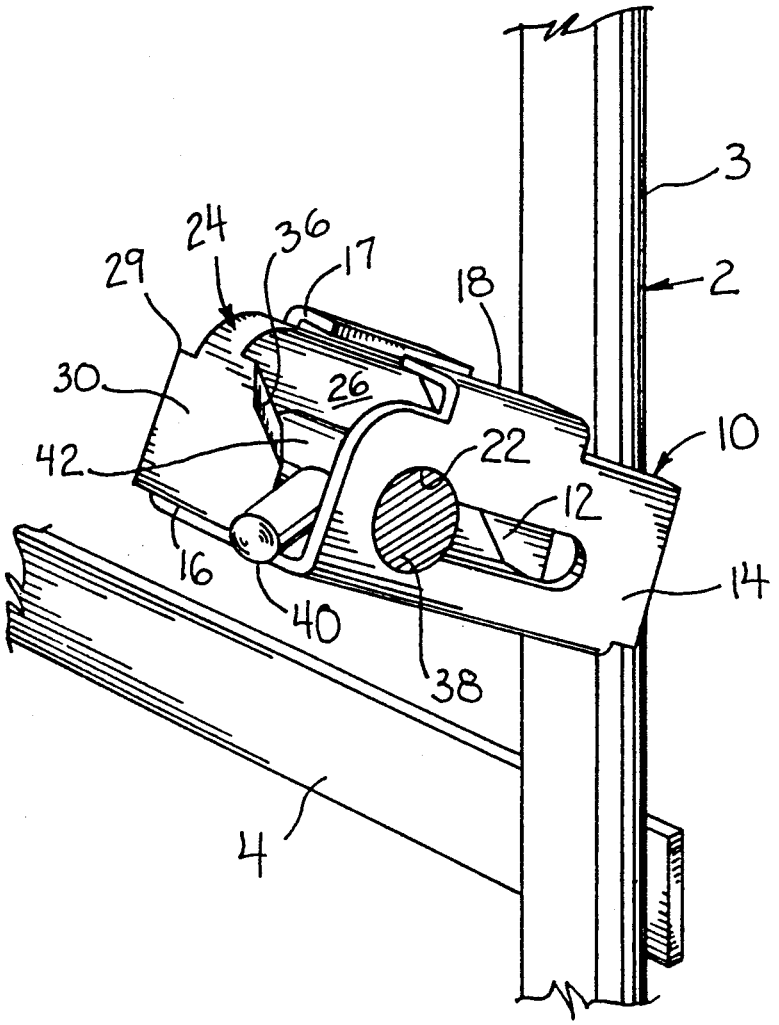
FIG. 1 is a perspective view of the bracket and insert of this invention carrying connected to a seat frame (partially shown). A common arm rest shaft and stop pin is shown to illustrate the environment of the invention.
Figure 2:
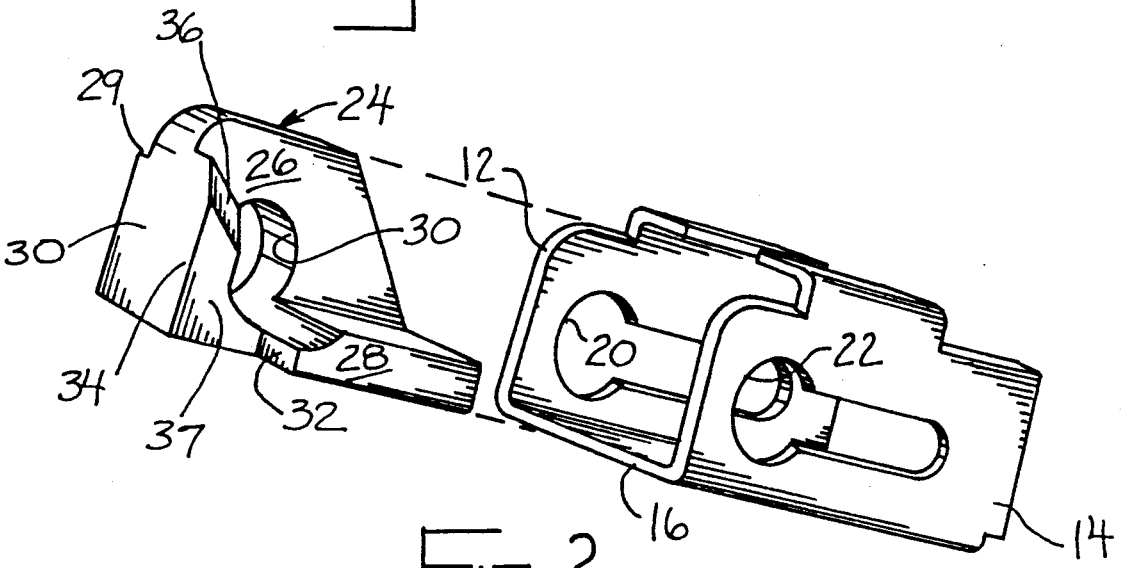
FIG. 2 is an exploded view of the bracket and insert.

The preferred embodiment herein disclosed is not intended to be exhaustive or to limit the application to the precise form disclosed. Rather, it is chosen and described in order to enable one skilled in the art to utilize its teachings.

A seat frame 2 is partially illustrated in the figure to depict the environment for the invention. Seat frame 2 includes a back support 3 having a plurality of cross braces 4 (only one shown) connected to a back support. The specific construction of seat frame 2 is known to the industry and does not constitute a novel portion of the invention.

Bracket 10 includes side walls 12, 14 interconnected by an integral bottom wall 16. A pair of flanges 17, 18 extend from the upper edge of side walls 12, 14 respectively and are bent into facing alignment as shown. Flanges 17, 18 terminate spaced from one another as illustrated. Aligned openings 20, 22 are formed through side walls 12, 14 respectively and each includes a longitudinal extension with the resultant opening resembling a keyhole shape as shown in the figures. Bracket 10 is connected to seat frame 2 by welding a rearward portion of the side walls 12, 14 and the bottom wall 16 to the back support 3. As illustrated bracket 10 is connected to back support such that bottom wall 16 is angled relative to the horizontal.

A one piece plastic or nylon insert 24 is carried by bracket 10 and is frictionally retained between the side walls 12, 14 and between flange 17 and bottom wall 16. Insert 24 includes a side wall 26 and a bottom wall 28. A bore 30 is formed through side wall 26 adjacent bottom wall 28. Bottom wall 28 includes an arcuate seat aligned with bore 30. A lip 29 extends from end 30 of side wall 26 to contact bracket side wall 12 and thereby limit insertion of insert 24 within the bracket to align bore 30 of the insert with openings 20, 22. A notch 32 formed in bottom wall 28 adjacent side wall 14 extends from end 30 of the insert. Insert 24 further includes an end wall 34 having a bevelled upper portion 36 and a generally vertical lower portion 37 which extends to notch 32 in the bottom wall.

Typically, an arm rest (not shown) includes a connecting rod or shaft 38 which includes a lateral stop pin 40 connected to the shaft. To connect the arm rest (not shown) to the frame 2, end 42 of shaft 38 is inserted into opening 22 in wall 14 such that pin 40 is aligned with the opening extension. The rod is pushed into bracket 10 until stop pin 40 contacts side wall 26 of insert 24. Rod 38 is partially journalled within bore 30 of insert 24 and extends through opening 20. The rod is rotated in a counterclockwise direction relative to FIG. 1 to cause pin 40 to pass between flanges 17 and 18. Continued rotation of the rod with arm rest attached (not shown) causes pin 40 to contact the upper bevelled portion 36 of insert end wall 34. The bevelled portion 36 of the insert end wall causes stop pin 40 to cam along its bevelled surface as the shaft 38 continues rotation. As the pin cams along the bevelled portion of the end wall the shaft is laterally shifted in a direction away from the insert. Rotation of shaft is halted when stop pin 40 contacts bottom wall 16. Pin 40 is frictionally contacting surface 37 of the insert and side wall 14 of the bracket which prevents vibration of the pin relative to the bracket to decrease vibration noise. In the preferred embodiment with stop pin 40 contacting bottom wall 16 the arm rest (not shown) is generally horizontal. When the arm rest is shifted into its raised or generally vertical position rod 38 rotates clockwise in FIG. 1 within bracket 10 and insert 24 until pin 40 contacts the end edge of flange 18. Contact between flange 18 and pin 40 defines the vertical position of the arm rest.

To remove an arm rest (not shown) connected to seat frame 2 by bracket 10 the arm rest is rotated into its raised position until stop pin 40 abuts flange 18. The rod and arm rest (not shown) are pushed in the direction of side wall 12 to shift pin 40 into contact with insert side wall 26. Side wall 26 aligns stop pin 40 with the space between flanges 17, 18 for continued counterclockwise rotation. As the rod is rotated in a counterclockwise direction relative to FIG. 1, pin 40 passed between the flanges and contacts insert bottom wall 28. Contact with the bottom wall 28 of the insert aligns stop pin 40 with the lateral extension of opening 22. The rod 38 may then be pulled laterally outward from the bracket.

As can be seen, insert 24 provides friction against movement of rod 38 to eliminate rattling of the pin and bracket while the vehicle is moving. Insert 24 also provides a camming surface and alignment surfaces for the easy insertion and removal of rod 28 from bracket 10.

It should be understood that the invention is not to be limited to the precise form disclosed but may be modified within the scope of the appended claims.

We claim:

1. A bracket for shiftable connection of an arm rest to a seat frame, said arm rest including a connecting rod having a stop member laterally extending from said rod, said bracket comprising a generally U-shaped bracket having a pair of spaced side walls interconnected by an integral bottom wall, aligned openings being formed in said side walls for accommodating said rod, at least one of said openings accommodating passage of said stop member through said one of said side walls, first and second abutment means carried by said bracket for engaging said stop member as said rod is rotated relative to said bracket, said abutment means defining rotational limits of said rod, and insert means carried by bracket frictionally engaging said rod and stop member for reducing vibration of said rod relative to said bracket, said insert means including a camming surface for engaging said stop member as said rod is shifted toward said first abutment means to urge said stop member into frictional engagement with said insert means and one of said bracket side walls.

2. The bracket of claim 1 wherein said insert further includes means contacted by said stop member for aligning said stop member with said one of said openings to facilitate removal of said connecting rod and stop member.

* * * * *